United States Patent [19]

Gotomyo

[11] 4,421,350

[45] Dec. 20, 1983

[54] FOOT-OPERATED, LATCH RELEASING MECHANISM FOR AUTOMOBILE DOORS

[75] Inventor: Yasuo Gotomyo, Hiroshima, Japan

[73] Assignee: Toyo Kogyo Co., Ltd., Hiroshima, Japan

[21] Appl. No.: 159,924

[22] Filed: Jun. 16, 1980

[30] Foreign Application Priority Data

Jun. 18, 1979 [JP] Japan ..... 54-77196
Jun. 18, 1979 [JP] Japan ..... 54-83816[U]

[51] Int. Cl.[3] ..... E05C 3/30
[52] U.S. Cl. ..... 292/123; 292/336.3
[58] Field of Search ..... 296/50; 292/123, 216, 292/94, 336.3, DIG. 23, DIG. 43, DIG. 72

[56] References Cited

U.S. PATENT DOCUMENTS

| | | | |
|---|---|---|---|
| 1,272,327 | 7/1918 | Bisaillon | 292/122 |
| 1,857,294 | 5/1932 | Larson | 242/DIG. 72 |
| 2,210,229 | 8/1940 | Boerner | 292/DIG. 72 |
| 2,649,321 | 8/1953 | Smith | 292/DIG. 23 |
| 3,623,764 | 11/1971 | Jacobi | 292/216 X |
| 4,073,170 | 2/1978 | Miyabayshi et al. | 292/DIG. 25 |
| 4,194,377 | 3/1980 | Maeda | 292/216 |

*Primary Examiner*—Richard E. Moore
*Attorney, Agent, or Firm*—Wenderoth, Lind & Ponack

[57] ABSTRACT

A foot-operated, latch releasing mechanism comprises a generally elongated foot-operated member having one end accessible to the foot and the other end pivotally connected to the vehicle body for movement between inoperative and operated position, a return biasing means for urging the foot-operated member towards the inoperative position and a linkage means for transmitting the movement of the foot-operated member from the inoperative position towards the operated position to cause a door latch assembly to be released.

11 Claims, 7 Drawing Figures

FOOT-OPERATED, LATCH RELEASING MECHANISM FOR AUTOMOBILE DOORS

BACKGROUND OF THE INVENTION

The present invention generally relates to a latch releasing mechanism and, more particularly, to a foot-operated latch releasing mechanism for use with automobile doors.

In general, an automobile of a type having a relatively large, covered cargo compartment behind the driver's seat, such as a van or a like commercial car, has a rear hatch door at the rear of the vehicle body for selectively opening and closing the rear opening of the vehicle body in readiness for the loading and unloading of cargos into and from the cargo compartment, respectively. This rear hatch door is supported for movement between opened and closed positions and is equipped with a door latch assembly for latching the rear hatch door in the closed position automatically when moved thereto. In addition to the door latch assembly, a biasing element, such as a torsion spring or a compression spring, is generally utilized to forcibly move the rear hatch door from the closed position a predetermined distance towards the opened position, when and after the latch assembly has been released, so that the rear hatch door can thereafter be moved manually towards the opened position. The latch assembly generally comprises a claw member operatively carried by the vehicle body adjacent the rear opening for movement between latched and unlatched positions, a lift spring element for biasing the claw member to assume the unlatched position and a striker fixedly carried by the vehicle body adjacent the claw member and engageable with the claw member to move the latter towards the latched position against the lift spring element.

In order to release the door latch assembly in readiness for the opening of the rear hatch door, there has been employed a latch releasing mechanism which comprises a manipulatable member operatively carried by the rear hatch door and a latch lever for transmitting a movement of the manipulatable member such that, when the manipulatable member is depressed or pulled by the application of an external pushing or pulling force while the rear hatch door is in the closed position, the claw member disengages from the striker to permit the rear hatch door to be opened. When the rear hatch door in the opened position is moved towards the closed position, the claw member is moved by the action of the lift spring element in contact with the striker and is then firmly engaged with, or more specifically, firmly arrests the striker to latch the rear hatch door in the closed position.

An example of the conventional door lock comprised of the door latch assembly and the latch releasing mechanism both of the constructions described above is disclosed in any one of the U.S. Pat. Nos. 4,073,170 and 4,194,377 (the latter corresponding to the Japanese Laid-open Utility Model Publication No. 52-114006 laid open to public inspection on Mar. 16, 1979) and the Japanese Laid-open Utility Model Publication No. 54-22722 laid open to public inspection on Feb. 14, 1979, although the manipulatable member employed in any one of these prior art references is comprised of a push-button with or without a cylinder lock built therein. In any event, the conventional door lock of the type referred to above functions satisfactorily.

However, it has been found inconvenient to manipulate the latch releasing mechanism particularly when both hands of the driver or a person carrying a cargo are occupied simultaneously. More specifically, when the driver or person carrying a cargo desires to open the rear hatch door in anticipation of the loading of the cargo into the cargo compartment, he or she has to put down the cargo temporarily so that he or she can manipulate the latch releasing mechanism. This procedure is not only time-consuming and uneconomical, but also tiring and laborious depending on the weight of the cargo to be loaded or unloaded.

SUMMARY OF THE INVENTION

Accordingly, the present invention has been developed for to substantially eliminating the inconveniences heretofore encountered with the prior art latch releasing mechanism and is intended to provide a novel foot-operated latch releasing mechanism which does not require the use of any hand in manipulating the latch releasing mechanism.

Another important object of the present invention is to provide a novel foot-operated latch releasing mechanism of the type referred to above, which has a foot pedal capable of not only releasing the door latch assembly, but also forcibly moving the hatch door a predetermined distance from the closed position towards the opened position, thereby enabling the substantially half-opened hatch door to be fully opened by the application of a slight pushing force thereto.

A further object of the present invention is to provide a novel foot-operated latch releasing mechanism of the type referred to above, in which a safety factor is taken into consideration so as to avoid any possible abrupt opening of the hatch door which would occur when the automobile is struck from behind.

A still further object of the present invention is to provide a novel foot-operated latch releasing mechanism of the type referred to above, which is easy and safe to operate by foot and which is attractive to both existing and potential owners of automobiles, particularly, those of vans or like commercial cars.

To this end, the present invention provides a novel foot-operated latch releasing mechanism for use in an automobile door assembly comprising at least one door supported for movement between opened and closed positions and a releaseable door latch assembly for latching the door in the closed position when and after the door has been moved thereto, said door latch assembly having a claw member operatively carried by the vehicle door for movement between latched and unlatched positions, a lift spring element for biasing the claw member to assume the unlatched position and a striker fixedly carried by the vehicle body adjacent the claw member and engageable with the claw member when the door is moved to the closed position. If desired, the door latch assembly to be used in association with the latch releasing mechanism of the present invention may also have a hand-operated member, which may be either a push-button with or without a cylinder lock built therein or a pivotally supported handle bar, and a latch lever for transmitting the movement of the hand-operated member to the claw member such that, when the push-button is depressed, or the pivotally supported handle bar is pulled, while the door is latched in the closed position, the claw member is disengaged from the striker to permit the door to be unlatched, and thereafter the door is forced by the lift spring element to move a predetermined distance towards the opened position so that the full opening of the door can readily be carried out with no difficulty.

The latch releasing mechanism according to the present invention comprises a generally elongated foot-operated member having one end accessible to the foot and the other end pivotally connected to the vehicle body for movement between inoperative and operated positions, a return biasing means for urging the foot-operated member towards the inoperative position and a linkage means for transmitting the movement of the foot-operated member from the inoperative position towards the operated position to cause the claw member to be disengaged from the striker.

Preferably, the latch releasing mechanism according to the present invention further comprises one or both of an opener for forcibly opening the door by itself or in cooperation with the door biasing means when the claw member is moved to the unlatched position disengaging from the striker and a delay means for delaying the operation of the door opener for a period of time until the claw member is completely moved to the unlatched position.

The foot-operated member may have a pedal pivotally mounted on the free end thereof for pivotal movement between disengaged and engaged positions and, in association therewith, the latch releasing mechanism may further comprise means for enabling the transmission of the movement of the foot-operated member from the inoperative and operated positions to the claw member only when the pedal is pivoted to the engaged position.

The foot-operated member is preferably so supported as to protrude outwardly and diagonally upwardly from the vehicle body in a direction rearwardly of the same vehicle body when it is in the inoperative position. By so doing, even when the automobile is struck from behind during read-end collision, the foot-operated member is forced to pivot in a direction counter to the direction of its normal movement from the inoperative position towards the operated position, thereby avoiding any possible abrupt opening of the automobile door.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
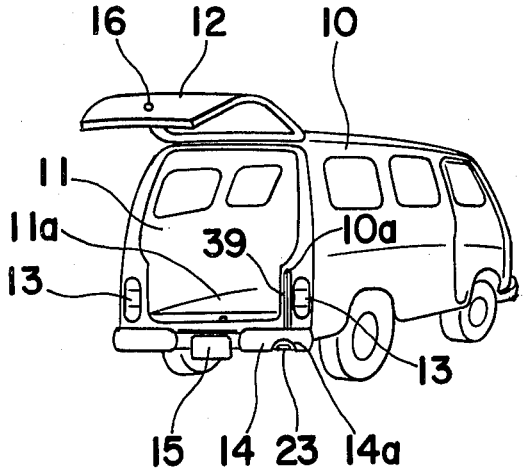
FIG. 1 is a schematic perspective view of a light-duty van to which the mechanism of the present invention is applied.

Before the description of the present invention proceeds, it is to be noted that like parts are designated by like reference numerals throughout the accompanying drawings.

Referring first to FIG. 1, a light-duty van currently commercially available is shown as comprising a vehicle body 10 of generally rectangular box-like configuration having a driver's cabin at the front thereof and a covered rear cargo compartment 11 behind the driver's cabin, said rear compartment 11 being defined by a floor panel 11*a*, a roof and a pair of opposed side wall structures all forming parts of the vehicle body 10. The vehicle body 10 also has a rear opening defined therein at a position opposite to the driver's cabin and leading into the rear compartment 11, said rear opening being adapted to be selectively closed and opened by a rear hatch door 12 which is hingedly supported by the roof of the vehicle body 10 for pivotal movement between closed and opened positions. Reference numerals 13 represent combined blinker and tail lamps and reference numerals 14 and 15 represent a rear bumper and a licence number plate, respectively, the licence number plate 15 being rigidly secured to the vehicle body 10.

Figure 3:
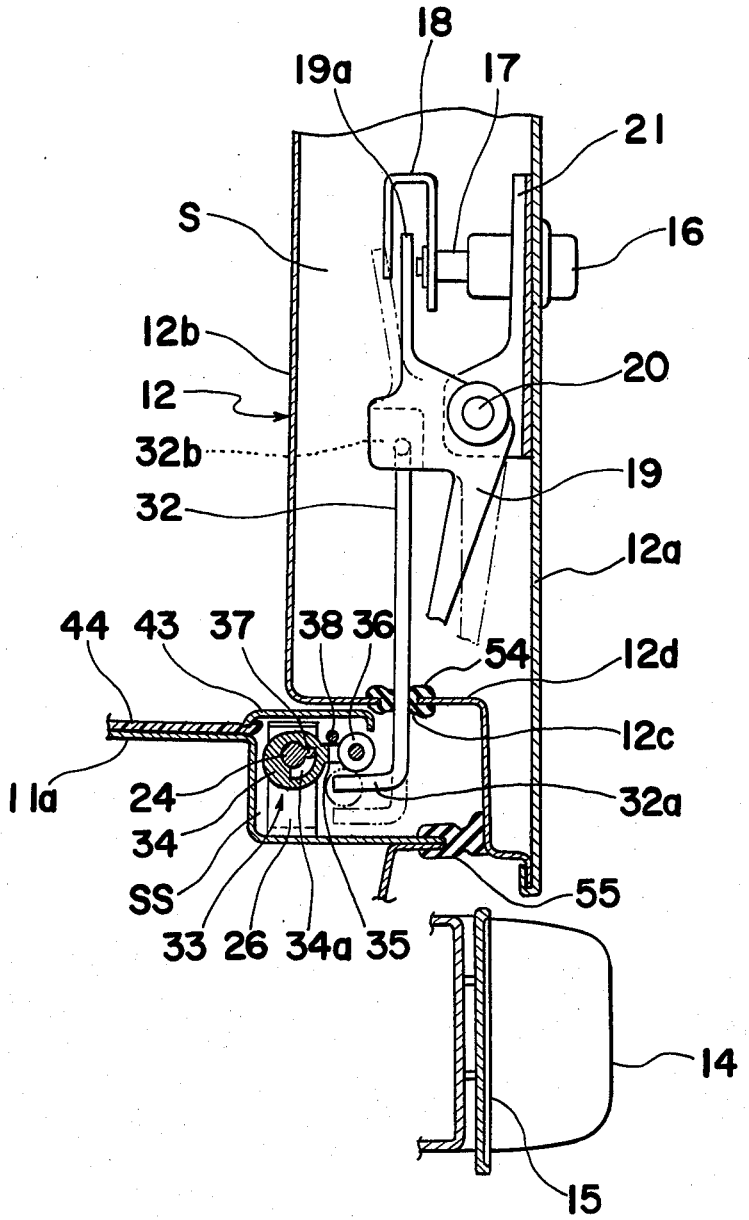
FIG. 3 is a cross sectional view, on a further enlarged scale, taken along the line III—III in FIG. 2.
Figure 5:
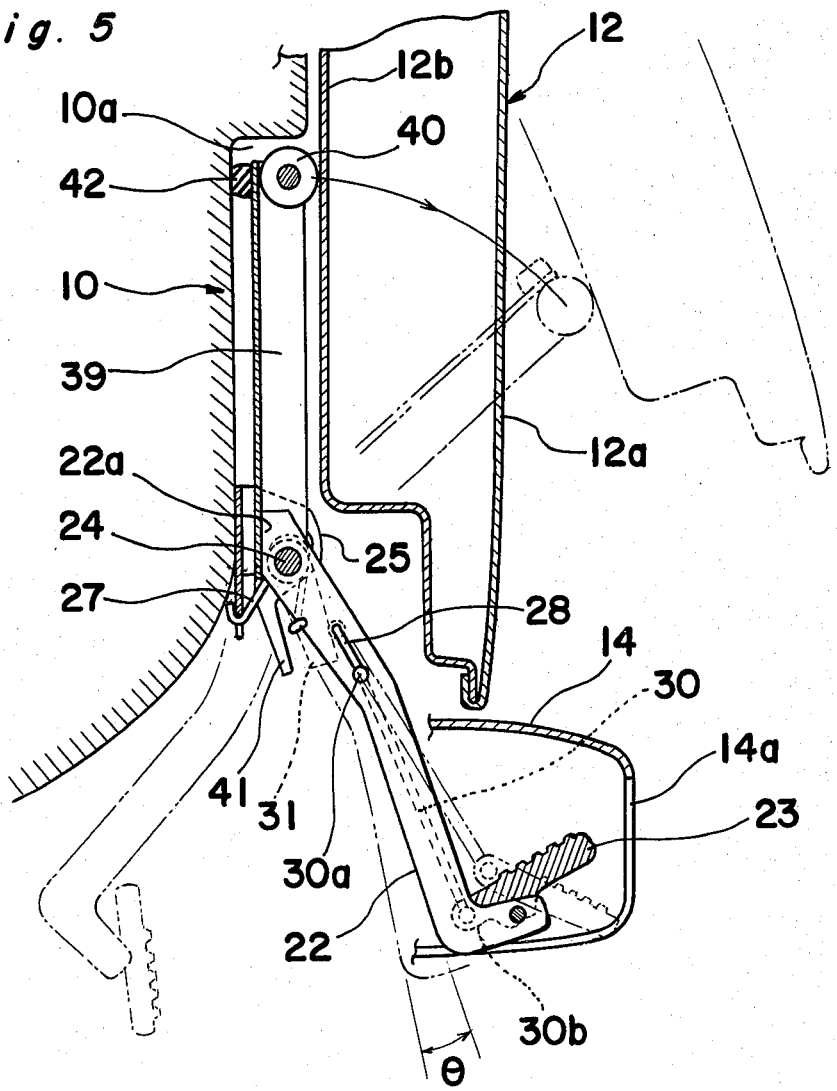
FIG. 5 is a cross sectional view, on a further enlarged scale, taken along the line V—V in FIG. 2.

As best shown in FIGS. 3 and 5, the rear hatch door 12 is comprised of an outer door panel 12*a* and an inner door panel 12*b* both rigidly connected, or otherwise welded, together along the perimeters thereof with a space S defined therebetween. This rear hatch door 12 has a releaseable door latch assembly including a claw member (not shown) operatively carried by the rear hatch door 12 for movement between latched and unlatched positions, and a finger-operated push-button 16 operatively supported by the outer door panel 12*a* for rotary and axial motions with respect to the longitudinal axis thereof and having a cylinder lock (not shown) built therein, it being to be understood that the push-button can be rotated, when a mating key is inserted in the built-in cylinder lock and then turned to unlock the built-in cylinder lock, and be axially displaced when an external pushing force is subsequently applied thereto, as is well known to those skilled in the art. The push-button 16 has a push rod 17 rigidly connected thereto for rotary and axial movement together therewith and is positioned within the space S between the outer and inner door panels 12*a* and 12 *b*.

Figure 2:
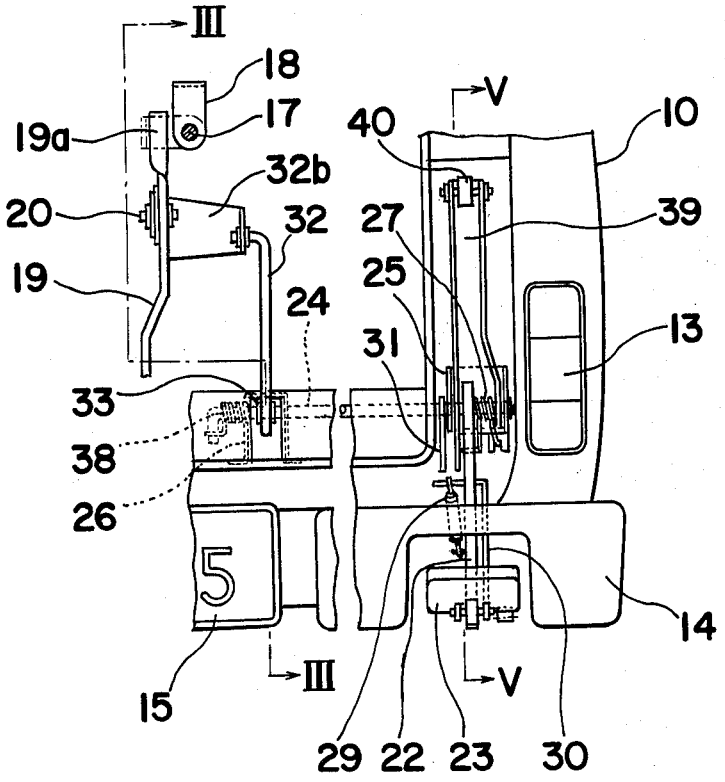
FIG. 2 is a rear end view, on an enlarged scale, of the van shown in FIG. 1, showing a latch releasing mechanism according to a first preferred embodiment of the present invention.

As best shown in FIGS. 2 and 3, the door latch assembly also includes a generally U-shaped trigger plate 18 having one end rigidly connected to the push rod 17 and a latch lever 19 having one end 19*a* adapted to engage the trigger plate 18 in a manner as will be described later and the other end operatively coupled to the claw member, a substantially intermediate portion of said latch lever 19 being pivotally supported by a bracket 21 fast with the outer door panel 12*a* for rotation thereabout between inoperative and operative positions. Although not shown, a striker is fixedly supported by the vehicle body at a position engageable with the claw member, when the rear hatch door 12 is moved to and held in the closed position, to latch the rear hatch door 12 in the closed position.

In the construction so far described, assuming that the rear hatch door 12 is in the closed position and the built-in cylinder lock is unlocked, the trigger plate 18 is held in a position as shown by the phantom line in FIG. 2 with the end 19*a* of the latch lever 19 situated within a space between the opposed ends of the trigger plate 18. This is because, as the mating key inserted into the built-in cylinder lock is turned to unlock the cylinder lock, the pushbutton 16 is rotated together therewith with the trigger plate 18 correspondingly rotated from a position shown by the solid line in FIG. 2 towards the position shown by the phantom lines in FIG. 2.

Subsequent application of an external pushing force to the push-button 16 results in the movement of the trigger plate 18 in a directon towards the inner door panel **12*b* parallel to the longitudinal axis of the push-button 16, and, accordingly, the latch lever 19 with its end 19*a* situated within the space between the opposed ends of the trigger plate 18 is pivoted counterclockwise about the pivot 20 from the inoperative position towards the operative position shown by the phantom lines in FIG. 3. When the latch lever 17 is so pivoted to the operative position, the claw member is moved from the latched position towards the unlatched position by the action of a lift spring element (not shown) used to urge the claw member to assume the unlatched position, thereby disengaging from the striker. Once the claw member disengages from the striker in the manner described above, the rear hatch door 12** is pivoted a predetermined distance from the closed position towards the opened position by the lift spring element.

When one shuts the rear hatch door 12 so opened, the claw member arrests the striker firmly and the rear hatch door 12 is accordingly latched in the closed position automatically. If the built-in cylinder lock is subsequently turned by the use of the mating key inserted thereinto to lock the cylinder lock, the trigger plate 18 is rotated to a position clear of the end **19*a* of the latch lever 19**.

The construction and function of the door latch assembly described above are well known to those skilled in the art. For example, the latch assembly disclosed in the U.S. Pat. No. 4,073,170 or the Japanese Laid-open Utility Model Publication No. 54-22722, laid open to public inspection on Feb. 14, 1978, may be employed for the purpose of the present invention and, accordingly, reference may be had thereto for the details thereof.

Referring to FIGS. 2 to 5, a foot-operated releasing mechanism embodying the present invention comprises a support lever 22 having one end carrying a pedal 23 mounted thereon for pivotal movement between first and second positions, the other end of said support lever 22 being mounted on a motion transmitting shaft 24 for rotation independently of the rotation of the shaft 24. The shaft 24 is rotatably supported by a pair of spaced, generally bifurcated brackets 25 and 26, rigidly secured to the rear end of the vehicle body at a position below the level of the floor **11*a* in the rear cargo compartment 11, and extends sidewise of the vehicle body 10. It is to be noted that the support lever 22 loosely mounted on the shaft 24 extends at right angles to the shaft 24 and, when in the inoperative position as shown by the solid lines in FIG. 5, protrudes diagonally downwardly therefrom in a direction rearwardly of the vehicle body 10 with the pedal 23 exposed to the outside through a cutout 14*a* in the rear bumper 14 as best shown in FIGS. 1 and 5. The cutout 14*a* in the rear bumper 14 serves as an access opening through which one can rest his or her foot on the pedal 23 in readiness for the opening of the rear hatch door 12** in a manner as will be described later.

As best shown in FIGS. 2 and 5, the support lever 22 is normally urged to assume the inoperative position, as shown by the solid lines in FIG. 5, by the action of a return spring which is shown as being in the form of a torsion spring 27 having one end connected to the bracket 25 and the other end connected to the support lever 22. This support lever 22 has a guide slot 28 defined at a portion of the support lever 22 adjacent the shaft 24, said guide slot 28 extending in a direction generally parallel to the longitudinal extent of said support lever 22. The pedal 23 on the free end of the support lever 22 is normally biased to the first position, as shown by the solid lines in FIG. 5, by the action of a tension spring 29 which is disposed, as best shown in FIG. 5, between a portion of the support lever 22 adjacent the pedal 23 and a trigger rod 30. More specifically, the trigger rod 30 has a first end **30*a* bent to protrude loosely through the guide slot 28 and with which one end of the tension spring 29 is engaged and the opposite, second end 30*b* pivotally connected to a rear portion of the pedal 23 on one side of the point of pivotal connection of the pedal 23 to the support lever 22, the other end of the tension spring 29 being so connected to that portion of the support lever 22 between the pedal 23 and the guide slot 28 as to urge the pedal 23 to assume the first position as shown by the solid lines in FIG. 5. It is to be noted that the length of a portion of the trigger rod 30 between the bent point and the second end 30*b* is so selected as to permit the first end 30*a* thereof to be engaged against first end of the guide slot 28 remote from the shaft 24 when the pedal 23 is in the first position as shown in FIG. 5. Accordingly, it will be clear that, when the pedal 23 is pivoted to the second position as shown by the phantom lines in FIG. 5 by a foot resting thereon, the first end 30*a* of the trigger rod 30 moves in the guide slot 28 to the opposite, second end of the guide slot 28, the pivotal movement of the pedal 23 from the first position towards the second position taking place against the biasing force of the tension spring 29**.

In order to transmit the angular movement of the support lever 22 to the shaft 24, an arm member 31 is rigidly mounted on the shaft 24 and protrudes laterally therefrom, the free end of said arm member 31 terminating at a position substantially halfway along the length of the guide slot 28. More specifically, the length of the arm member 31 is so selected that, only when and after the support lever 22 has been pivoted a predetermined angle $\theta$ about the shaft 24 from the inoperative position towards the operated position while the pedal 23 has been pivoted to the second position with a foot resting thereon, is the first end **30*a* of the trigger rod 30 engaged with the free end of the arm member 31 thereby pivoting the shaft 24 clockwise as viewed in FIG. 5 during the rest of the angular movement of the support lever 22** towards the operated position.

Figure 4:
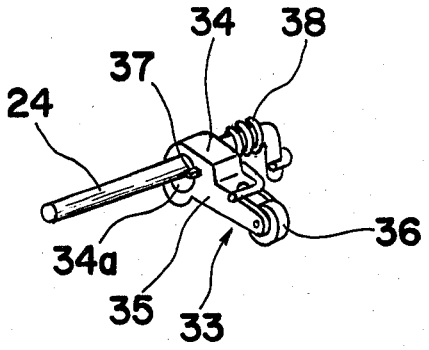
FIG. 4 is a perspective view, showing the manner by which an actuating member forming a part of the latch releasing mechanism shown in FIGS. 2 and 3 is supported on a shaft member.

As best shown in FIGS. 2 to 4, the latch releasing mechanism further comprises an operating rod 32 having one end pivotally connected to a coupling plate **32*b* which is in turn rigidly connected to a substantially intermediate portion of the latch lever 19 adjacent the point of pivot 20 of the latch lever 19, the other end of said operating rod 32 being bent at 32*a* and situated outside the rear hatch door 12 while a substantially intermediate portion of said operating rod 32 extends downwards through the space S and then to the outside of the rear hatch door 12 through an aperture 12*c* defined in a shoulder portion 12*d* of the inner door panel 12*b*. The bent end 32*a* of the operating rod 32 extends in a direction frontwardly of the vehicle body 10 and generally at right angles to the rear hatch door 12 as best shown in FIG. 3**.

The operating rod 32 serves to pivot the latch lever 19 from the inoperative position towards the operative position shown by the phantom lines in FIG. 3 when it is pulled downwards in a manner as will be described later, said operating rod 32 being however upwardly shifted when the latch lever 19 assumes the inoperative position when the claw member is moved into contact with the striker from the unlatched position towards the latched position by the action of the lift spring element during the closure of the rear hatch door 12.

Operatively associated with the bent end 32*a* of the operating rod 32 and operatively mounted on the shaft 24 in the vicinity of the bracket 26 is an actuating member, generally identified by 33, of a construction best shown in FIG. 4. Referring particularly to FIG. 4, the actuating member 33 comprises a generally cylindrical body 34, rotatably mounted on the shaft 24, and a carrier arm 35 integrally formed with, or otherwise rigidly connected to, the cylindrical body 34 and protruding outwardly therefrom in a direction at right angles to the longitudinal axis of the shaft 24. The carrier arm 35 has a free end bifurcated and carrying a roller element 36 for rotation in a plane perpendicular to the longitudinal axis of the shaft 24.

The actuating member 33 of the construction hereinabove described and best shown in FIG. 4 is rotatable through a limited angle about the longitudinal axis of the shaft 24. For this purpose, the actuating member 33 has a generally arcuate indent 34*a* defined in one end face of the cylindrical body 34 and extending a predetermined angular distance about the longitudinal axis of the shaft 24, one side edge of the arcuate indent 34*a* remote from the outer perimeter of the cylindrical body 34 being communicated to and opening into the hollow of the cylindrical body 34 through which the shaft 24 extends. On the other hand, a stop pin 37 cooperable with the arcuate indent 34*a* in a manner as will be described later is rigidly mounted on the shaft 24 and extends therefrom in a direction at right angles to the longitudinal axis of said shaft 24. This stop pin 37 so extending from the shaft 24 is loosely engaged within the arcuate indent 34*a* so that, when the actuating member 33 is rotated in either direction about the longitudinal axis of the shaft 24 independently of such shaft 24, the stop pin 37 will be engaged with a corresponding end of the arcuate indent 34*a* in the cylindrical body 34.

The actuating member 33 is normally biased clockwise, as viewed in FIG. 3, about the shaft 24, tending to assume a lowered position, by the action of a torsion spring 38 having one end connected to the shaft 24 and the other end connected to the carrier arm 35 of the actuating member 33 as best shown in FIG. 4. However, since the biasing force exerted by the torsion spring 27 is larger than, and acts in a direction opposite to, that of the torsion spring 38, the actuating member 33 is, when and so long as the latch releasing mechanism of the present invention is not operated or, if it be operated, during the pivotal movement of the support lever 22 through the predetermined angle $\theta$, held in position biased counterclockwise thereby assuming a lifted position as shown by the solid lines in FIG. 3. When and so long as the actuating member 33 is held in the lifted position for the reason described above, the stop pin 37 is engaged with the trailing end of the arcuate indent 34*a* with respect to the direction in which the actuating member 33 is biased by the torsion spring 38. In addition, when and so long as the actuating member 33 is held in the lifted position and, at the same time, when and so long as the rear hatch door 12 is in the closed position as shown in FIG. 3, the carrier arm 35 of the actuating member 33 extends generally in parallel to the bent end 32*a* of the operating rod 32 in the upwardly shifted position with the roller element 36 resting thereon.

The latch releasing mechanism of the construction so far described functions satisfactorily in the following manner. Assuming that the rear hatch door 12 is latched in the closed position, and after the support lever 22 has been pivoted the predetermined angle $\theta$ about the shaft 24 by a foot resting on the pedal 23 which is then pivoting against the tension spring 29 from the first position shown by the solid lines in FIG. 5 towards the second position shown by the phantom lines in FIG. 5, the first end 30*a* of the trigger rod 30 is brought into contact with the free end of the arm member 31 fast with the shaft 24. The continued pivotal movement of the support lever 22 towards the operative position shown by the phantom lines in FIG. 5 consequently causes the shaft 24 to rotate clockwise as viewed in FIGS. 3 and 5 and, accordingly, the stop pin 37 on the shaft 24 tends to separate from the trailing end of the arcuate indent 34*a* in the cylindrical body 34 of the actuating member 33. However, since the actuating member 33 is biased by the torsion spring 38 so as to assume the lowered position, the actuating member 33 is rotated by the action of the torsion spring 38 together with the shaft 24 with the trailing end of the arcuate indent 34*a* substantially constantly held in contact with the stop pin 37. As the actuating member 33 is rotated from the lifted position towards the lowered position in the manner described above incident to the rotation of the shaft 24 in the clockwise direction, the roller element 36 carried by the actuating member 33 and then resting on the bent end 32*a* of the operating rod 32 applies a downward pulling force to the operating rod 32, thereby pulling the operating rod 32 downwards. By so doing, the latch lever 19 is pivoted from the inoperative position towards the operated position, thereby unlatching the door latch assembly to permit the rear hatch door 12 to open.

Thereafter, and shortly before the support lever 22 which is still being pivoted towards the operated position arrives at the operated position, the first end 30*a* of the trigger rod 30 which has been engaged with the arm member 31 will disengage therefrom, thereby allowing the arm member 31 to pivot counterclockwise about the shaft 24 together with said shaft 24 by the action of the torsion spring 27 back to the initial position. This in turn results in the return of the actuating member 33 back to the lifted position against the torsion spring 38. The above described disengagement of the first end 30*a* of the trigger rod 30 from the arm member 31 shortly before the arrival of the support lever 22 at the operated position occurs when the pedal 23 with the foot resting thereon is pivoted from the first position to the second position and then back to the first position during the course of pivotal movement of the support lever 22 from the inoperative position to the operated position.

After the rear hatch door 12 has been opened in the manner as hereinbefore described, the various movable parts of the latch releasing mechanism return to their original positions by the action of the associated biasing elements. On the other hand, when the rear hatch door 12 is moved from the opened position so as to be closed, not only is the claw member brought into the latched position in the manner as hereinbefore described in connection with the door latch assembly, but also the bent end 32*a* of the operating rod 32 protrudes underneath the roller element 36.

The latch releasing mechanism of the construction so far described is satisfactory and effective where a door biasing means, such as a torsion spring as is widely employed in the currently commercially available vans or like commercial cars, is employed for urging the rear hatch door 12 so as to move a predetermined angular distance or throughout the whole stroke from the closed position towards the opened position. However, in consideration of the premise on which the present invention is based, and in order to assure that the rear hatch door 12 can always be opened immediately after the operating rod 32 has been pulled downwards, the use of a forced door opener mechanism in association with the latch releasing mechanism is recommended in combination with or separately of the door biasing means. This forced door opener mechanism will now be described with particular reference to FIGS. 2 and 5.

Referring now to FIGS. 2 and 5, the forced door opener mechanism comprises an opener lever 39 of generally C-shaped cross section having one end carrying a roller element 40 rotatably mounted thereon, the other end of said lever 39 being mounted on the shaft 24 at a position between the opposed arms of the bifurcated bracket 25 for rotation about the shaft 24 independently of the shaft 24. This opener lever 39 is pivotable about the shaft 24 between retracted and kicked positions in a manner as will subsequently be described.

The opener lever 39 has an operating finger 41 rigidly connected to, or otherwise integrally formed with, the second mentioned end of the lever 39 adjacent the bracket 25 and protrudes downwardly and diagonally outwardly therefrom with the free end thereof held in position ready to engage the first end 30*a* of the trigger rod 30 during the pivotal movement of the support lever 22 from the inoperative position towards the operated position. As can readily be understood from FIG. 1, the opener lever 39 when in the retracted position is accommodated within a generally elongated recess 10*a* defined in one rear side pillar forming a part of the vehicle body 10. This opener lever 39 is, when the support lever 22 is in the inoperative position, held in the retracted position as shown by the solid lines in FIG. 5 by the action of the torsion spring 27, the biasing force of the torsion spring 27 being transmitted to the opener lever 39 through the end of the support lever 22 remote from the pedal 23 which is held in contact with the wall of the opener lever 39. For this purpose, that end of the support lever 22 remote from the pedal 23 and held in contact with the wall of the opener lever 39 is flattened as at 22*a*. It is to be noted that, in the embodiment shown in FIGS. 2 to 5, the engagement of the flattened end 22*a* of the support lever 22 with the wall of the opener lever 39 in the manner as shown in FIG. 5 concurrently defines the inoperative position for the support lever 22.

With the forced door opener mechanism constructed as hereinbefore described, it is clear that, assuming that the rear hatch door 12 is in the closed position and after the support lever 22 has been pivoted the predetermined angle $\theta$ towards the operated position with the first end 30*a* of the trigger rod 30 already engaged with the free end of the arm member 31, the first end 30*a* of the trigger rod 30 is brought into contact with the free end of the operating finger 41, thereby causing the opener lever 39 to pivot from the retracted position towards the kicked position as shown by the phantom lines in FIG. 5. It is to be noted that, in view of the fact that the arm member 31 and the operating finger 41 are angularly spaced a certain distance from each other with respect to the longitudinal axis of the shaft 24, the pivotal movement of the opener lever 39 from the retracted position towards the kicked position is initiated subsequent to the unlatching of the door latch assembly. Therefore, as the opener lever 39 pivots from the retracted position towards the kicked position, the roller element 40 forcibly opens the rear hatch door 12 in contact therewith.

The opener lever 39 of the forced door opener mechanism of the construction described above may have an elastic bumper, such as shown by 42 in FIG. 5, for protecting the associated rear side pillar of the vehicle body 10 from being struck by the opener lever 39 when the latter is returned to the retracted position by the action of the torsion spring 38.

As best shown in FIG. 3, in order to accommodate a portion of the shaft 24, the bracket 26 and a motion translator including the actuating member 33 and its associated parts, the rear end of the floor 11*a* adjacent the rear opening in the vehicle body is stepped down to provide a space SS extending generally sidewise of the vehicle body 10, said space SS being substantially covered by a generally elongated overhang shroud 43 which has one side edge rigidly connected to, or otherwise welded to, the floor 11*a*. Reference numeral 44 designates a floor mat spread over the floor 11*a* inside the rear cargo compartment 11.

In the latch releasing mechanism according to the first preferred embodiment of the present invention constructed as hereinbefore fully described, it is to be noted that the employment of a combination of the arcuate indent 34*a* and the stop pin 37, both best shown in FIG. 4, is not always essential. It is possible to rigidly mount the actuating member 33 on the shaft 24 for rotation together therewith and, in such case, the torsion spring 38 can be omitted. In addition, unless the possibility of the rear hatch door 12 being abruptly opened at the time of the rear-end collision is taken into consideration, the support lever 22 may be rigidly mounted on the shaft 24 with both the arm member 31 and the trigger rod 30 consequently omitted.

In any event, so far as the first preferred embodiment of the present invention is concerned, since the pedal in the first position is tilted diagonally upwardly in a direction rearwardly of the vehicle body 10 relative to the support lever 22 and is so designed as to permit the support lever 22 to pivot idly towards the operated position unless the pedal 23 is forced by the foot to pivot from an first position towards the second position, the automobile rear-end collision of a type frequently occurring in the streets would not result in the accidental opening of the rear hatch door 12.

Hereinafter, the latch releasing mechanism according to the second preferred embodiment of the present invention, which is more simplified than that shown in FIGS. 2 to 5, will be described with particular reference to FIGS. 6 and 7.

Figure 6:
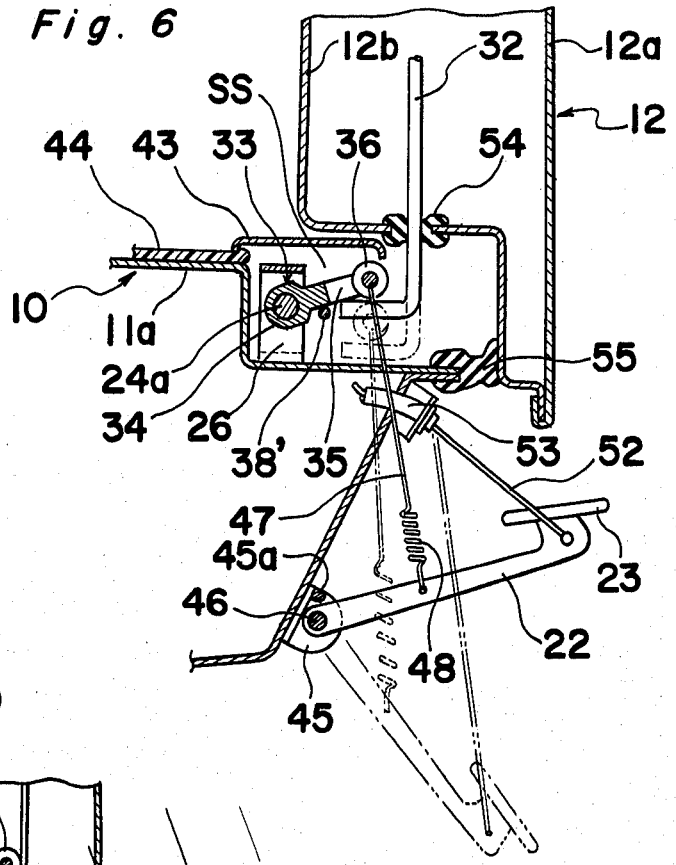
FIGS. 6 and 7 are views similar to FIGS. 3 and 5, showing a latch releasing mechanism according to a second preferred embodiment of the present invention.
Figure 7:
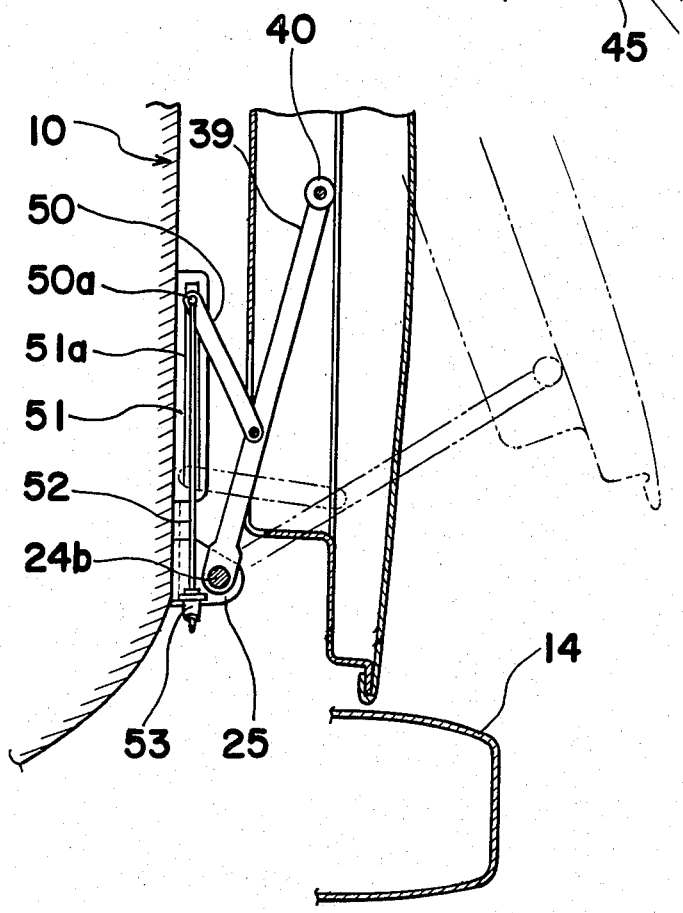

Referring now to FIGS. 6 and 7, the actuating member 33 is shown as rigidly mounted on a shaft member 24*a* having its opposite ends journalled in the brackets 26 and, unlike the actuating member 33 shown in FIGS. 2 to 4 which tends to assume the lowered position by the action of the torsion spring 38, urged counterclockwise about the shaft member 24*a* to assume the lifted position by the action of a torsion spring 38'.

The pedal 23 in the embodiment shown in FIGS. 6 and 7 is rigidly mounted on, or otherwise integrally formed with, the support lever 22. This support lever 22 is supported at a lower rear end of the vehicle body 10 by a bracket 45 for pivotal movement between the inoperative and operated positions about a shaft member 46 having its opposite ends journalled in brackets 45 and is normally biased counterclockwise about the shaft member 46 as viewed in FIG. 6 by the action of a pull rod 47 having one end connected to the free end of the carrier arm 35 of the actuating member 33 and the other end connected to the support lever 22 through a tension spring 48. However, since the biasing force exerted by the torsion spring 38' is substantially equal to or slightly smaller than the biasing force exerted by the tension spring 48, the support lever 22 biased counterclockwise about the shaft member 46 by the action of the tension spring 48 is forced to assume the inoperative position as shown by the solid lines in FIG. 6 by the action of the torsion spring 38'. It is to be noted that the bracket 45 has a stop member 45*a* rigidly mounted thereon, or otherwise integrally formed therewith, for defining the inoperative position of the support lever 22. It is also to be noted that, in the embodiment shown in FIGS. 6 and 7, the support lever 22 should be supported so as to protrude diagonally upwardly from the bracket 45 in a direction rearwardly of the vehicle body 10, when in the inoperative position. By so doing, an undesirable and accidental pivotal movement of the support lever 22 from the inoperative position towards the operated position which would occur during an automobile rear-end collision can advantageously be eliminated.

In the construction so far described, it will readily be seen that the pivotal movement of the support lever 22 from the inoperative position towards the operated position, which is effected by treadling the pedal 23, results in the rotation of the actuating member 33 from the lifted position towards the lowered position. More specifically, as the support lever 22 is pivoted from the inoperative position towards the operated position, the torsion spring 38' is first overcome by the treadling force applied to the support lever 22 through the pedal 23 and, thereafter, the tension spring 48 expands axially outwardly. Accordingly, the actuating member 33 is rotated by the action of the treadling force from the lifted position towards the lowered position, thereby pulling the operating rod 32 downwards to unlatch the door latch assembly in the manner as hereinbefore described in connection with the first preferred embodiment of the present invention with reference to FIGS. 2 to 5.

The opener lever 39 pivotally mounted on a shaft member 24*b*, carried by the brackets 25, for movement between the retracted and kicked positions has a substantially intermediate portion pivotally connected to an articulating link 50, the free end of said link 50 having a guide pin 50*a* rigidly or rotatably secured thereto. Rigidly secured to the rear side pillar of the vehicle body at a position immediately above the bracket 25 is a guide member 51 having a guide slot 51*a* defined therein, said guide pin 50*a* on the link 50 being slidingly engaged in said guide slot 51*a*. The forced door opener mechanism employed in the second preferred embodiment shown in FIGS. 6 and 7 is so designed that, when the opener lever 39 is in the retracted position as shown by the solid lines in FIG. 7, the guide pin 50*a* is engaged in an upper end of the guide slot 51*a* in the guide member 51 and, when the opener lever 39 is in the kicked position as shown by the phantom lines in FIG. 7, the guide pin 50*a* is engaged to a lower end of the guide slot 51*a*.

As best shown in FIGS. 6 and 7, the articulating link 50 is connected to the support lever 22 by means of a traction cable 52 having one end rigidly connected to the free end of the link 50 adjacent the guide pin 50*a* and the other end rigidly connected to the free end of the support lever 22 adjacent the pedal 23, a substantially intermediate portion of said traction cable 52 extending movably through a sheath 53 which has one end rigidly secured to the bracket 25 and the other end rigidly secured to the lower rear end of the vehicle body 10. The traction cable 52 has a length so selected that, when the support lever 22 is pivoted from the inoperative position towards the operated position, the articulating link 50 is pivoted with the guide pin 50*a* moving from the upper end of the guide slot 51*a* towards the lower end of the same guide slot 51*a*. Accordingly, it will readily be seen that, as the guide pin 50*a* moves from the upper end of the guide slot 51*a* towards the lower end of the same guide slot 51*a* incident to the pivotal movement of the support lever from the inoperative position towards the operated position, the opener lever 39 is pivoted about the shaft member 24*b* from the retracted position towards the kicked position, thereby forcibly opening the rear hatch door 12.

Preferably, the traction cable 52 is slightly loosened so that the pivotal movement of the opener lever 39 from the retracted position towards the kicked position can be initiated after the door latch assembly has completely been released, that is, after the support lever 22 has been pivoted a predetermined angular distance about the shaft member 46 from the inoperative position towards the operative position.

It is to be noted that, in FIGS. 3 and 6, reference numeral 54 designates a ring-shaped gasket or any suitable seal ring through which the operating rod 32 moves axially slidingly and reference numeral 55 designates a cushioning member extending sidewise of the vehicle body 10 for absorbing shocks which would be generated when the rear hatch door 12 is shut.

Although the present invention has fully been described in connection with the preferred embodiments thereof with reference to the accompanying drawings, it is to be noted that various changes and modifications will be apparent to those skilled in the art. By way of example, in the embodiment shown in FIGS. 6 and 7, although the shaft members 24*a* and 24*b* have been described and shown as separate from each other, a single shaft may be employed for these members 24*a* and 24*b*. Where a single shaft is employed for these members 24*a* and 24*b*, the employment of a combination of the arcuate indent and the pin such as shown by 34*a* and 37 in FIG. 4, respectively, in the embodiment of FIGS. 6 and 7 is preferred in order to ensure that the rear hatch door 12 will be forcibly opened shortly after the door latch assembly has been released. In addition, where the single shaft is employed for the members 24*a* and 24*b* and, concurrently, the combination of the arcuate indent and the pin such as shown by 34*a* and 37 in FIG. 4, respectively, is employed, the opener lever 39 shown in FIG. 7 may be rigidly mounted for rotation together with such single shaft. In such case, the articulating link 50, the guide member 51 and the traction cable 52 and their associated parts may be omitted.

Moreover, although the present invention has been described as applied to the rear hatch door 12, the concept of the present invention is equally applicable to a side sliding door utilized in another type of van or like commercial car singly or in combination with the rear hatch door 12.

Accordingly, such changes and modifications are to be understood as included within the true scope of the present invention unless they depart therefrom.

I claim:

1. A foot-operated, latch releasing mechanism for a door assembly having at least one door supported for movement between opened and closed positions, a releaseable door latch assembly for latching the door in the closed position when and after the door has been moved thereto, said door latch assembly including a claw member operatively supported for movement between latched and unlatched positions, and a striker engageable with the claw member when the door is moved to the closed position to latch the door in the closed position in cooperation with the claw member in the latched position, said foot-operated, latch releasing mechanism comprising, in combination:

a generally elongated foot-operated member supported for pivotal movement between inoperative and operated positions and having one end adapted to receive a treadling force necessary to move said foot-operated member from the inoperative position towards the operated position;

a return biasing means for urging the foot-operated member towards the inoperative position;

a latch release lever supported by the door for movement between first and second operative positions and operable to move the claw member from the latched position towards the unlatched position when said latch release lever is pivoted from the first operative position towards the second operative position, said latch release lever being normally biased to the first operative position, an operating rod having one end pivotally connected to the latch release lever and the other end protruding to the outside of the door, a substantially intermediate portion of said operating rod being axially movably supported by the door, an actuating means supported for rotation in first and second directions opposite to each other, said actuating means being operable to move the operating rod in a direction required to cause the latch release lever to move from the first operative position towards the second operative position as said actuating means is rotated in the first direction, and a motion transmitting means for causing the actuating means to rotate in the first direction in response to the movement of the foot-operated member from the inoperative position towards the operated position; and a forced door opener including an opener lever supported for pivotal movement between retracted and kicked positions, said opener lever being pivoted from the retracted position towards the kicked position in response to the release of the door latch assembly for forcibly opening the door.

2. A mechanism as claimed in claim 1, wherein said motion transmitting means includes a shaft member, said foot-operated member and said actuating means being mounted on said shaft member.

3. A mechanism as claimed in claim 2, wherein said one end of the foot-operated member is constituted by a pedal mounted thereon for pivotal movement between first and second positions, said pedal being adapted to pivot from the first position to the second position and then back towards the first position during the pivotal movement of the foot-operated member from the inoperative position to the operated position by the application of the external treadling force to the pedal, and further comprising a first spring element for urging the pedal to assume the first position.

4. A mechanism as claimed in claim 3, wherein said foot-operated member is mounted on the shaft member for rotation independently of the shaft member and said shaft member has an engagement arm rigidly mounted thereon, and further comprising a clutching means operable to connect the foot-operated member to the engagement arm to rotate the shaft member only after the foot-operated member has been pivoted a predetermined angle about the shaft member while the pedal is at the same time pivoted from the first position to the second position against the first spring element.

5. A mechanism as claimed in claim 4, wherein said clutching means comprises a triggering rod having one end pivotally connected to the pedal and the other end loosely protruding through a guide slot defined in the foot-operated member, said first spring element being suspended between said other end of the triggering rod and the foot-operated member such that, when and so long as the pedal is in the first position, said other end of the triggering rod is engaged to one of the opposed ends of the guide slot, said other end of the triggering rod when engaged to the other of the opposed ends of the guide slot as a result of the pivotal movement of the pedal from the first position to the second position during the pivotal movement of the foot-operated member through the predetermined angle being engageable with the engagement arm to transmit the movement of the foot-operated member to the shaft member.

6. A mechanism as claimed in claim 3, 2, 4 or 5, wherein further comprising a second spring element for urging the actuating member to rotate in the first direction, said second spring element exerting a biasing force smaller than, and acting in a direction opposite to, that of the return biasing means for urging the foot-operated member towards the inoperative position.

7. A mechanism as claimed in claim 1, wherein said motion transmitting means includes a pull rod having one end connected to the actuating member and a third spring element having one end connected to the other end of the pull rod and the other end connected to the foot-operated member, and wherein further comprising a fourth spring element for urging the actuating member to rotate in the second direction, said third spring element exerting a biasing force larger than, and acting in a direction opposite to, that of the fourth spring element, the total length of said pull rod and said third spring element being so selected that, when the foot-operated member is in the inoperative position, said actuating member is urged in the second direction.

8. A mechanism as claimed in claim 2, wherein said opener lever is mounted on the shaft member.

9. A mechanism as claimed in claim 8, wherein said opener lever is mounted on the shaft member for rotation independently of the shaft member, and further comprising an additional motion transmitting means for causing the opener lever to pivot from the retracted position towards the kicked position only after the foot-operated member has been pivoted a further predetermined angle about the shaft member subsequent to the pivotal movement of the foot-operated member through the predetermined angle towards the operated position.

10. A mechanism as claimed in claim 9, wherein said additional motion transmitting means comprises an arm member rigidly mounted on the shaft member and engageable with said other end of the triggering rod during the pivotal movement of the foot-operated member towards the operated position.

11. A mechanism as claimed in claim 7, wherein said forced door opener further includes an elongated flexible connecting element having one end connected to the foot-operated member and the other end operatively coupled to the opener lever, said flexible connecting element being operable to move the opener lever from the retracted position towards the kicked position as the foot-operated member is moved from the inoperative position towards the operated position.

* * * * *